US008570224B2

(12) United States Patent
Mattis

(10) Patent No.: US 8,570,224 B2
(45) Date of Patent: Oct. 29, 2013

(54) APPARATUS PROVIDING THERMAL MANAGEMENT FOR RADIO FREQUENCY DEVICES

(75) Inventor: Eric Stephen Mattis, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 444 days.

(21) Appl. No.: 12/778,922

(22) Filed: May 12, 2010

(65) Prior Publication Data

US 2011/0279331 A1 Nov. 17, 2011

(51) Int. Cl.
*H01Q 1/24* (2006.01)

(52) U.S. Cl.
USPC ..... 343/702; 343/700 MS

(58) Field of Classification Search
USPC ..... 343/702, 700 MS, 846
See application file for complete search history.

(56) References Cited

U.S. PATENT DOCUMENTS 6,456,249 B1 * 9/2002 Johnson et al. ..... 343/702
7,508,347 B2 * 3/2009 Sakama et al. ..... 343/700 MS
8,051,550 B2 * 11/2011 Cheng et al. ..... 29/600
2001/0048397 A1 12/2001 Smith
2002/0145567 A1 * 10/2002 Spiegel et al. ..... 343/700 MS
2003/0096585 A1 5/2003 Danet et al.

FOREIGN PATENT DOCUMENTS

EP 1737065 A1 12/2006
WO WO2008012533 A1 1/2008

OTHER PUBLICATIONS

International Search Report and Written Opinion—PCT/US2011/036354—ISA/EPO—Jul. 29, 2011.

* cited by examiner

*Primary Examiner* — Hoanganh Le
(74) *Attorney, Agent, or Firm* — Ramin Mobarhan

(57) ABSTRACT

Apparatus providing thermal management for radio frequency devices. An antenna is provided that includes an antenna body configured for transmitting electrical signals, and one or more mounting surfaces coupled to the antenna body, the one or more mounting surfaces configured for mounting to a device surface so that a resulting thermal resistance ($R_{th}$) between the device surface and the antenna body is less than 15 degrees centigrade per watt. The antenna body forms one of a PIFA antenna, whip antenna, patch antenna, or a meandered patch antenna.

20 Claims, 5 Drawing Sheets

600

| | 602 Antenna portion | 604 $R_{th}$ | 606 t | 608 k | 610 L | 612 W | 614 A |
|---|---|---|---|---|---|---|---|
| 616 | Solder type 1 | .30 | .0889 | 30 | 2.5 | 4 | 10 |
| | Solder type 2 | .18 | .0889 | 50 | 2.5 | 4 | 10 |
| 618 | Therm I/F 1 | 1.30 | .12 | 9.23 | 2.5 | 4 | 10 |
| | Therm I/F 2 | .97 | .12 | 12.37 | 2.5 | 4 | 10 |
| | Therm I/F 3 | .35 | .12 | 34.28 | 2.5 | 4 | 10 |
| 620 | Foot - BeCu | 3.08 | .25 | 65 | 2.5 | .5 | 1.25 |
| | Foot - Cu | .52 | .25 | 385 | 2.5 | .5 | 1.25 |
| | Foot - Cu194 | .77 | .25 | 261 | 2.5 | .5 | 1.25 |
| 622 | Leg - BeCu | 123.08 | 5 | 65 | 2.5 | .25 | .625 |
| | Leg - Cu | 20.78 | 5 | 385 | 2.5 | .25 | .625 |
| | Leg - Cu194 | 30.65 | 5 | 261 | 2.5 | .25 | .625 |

APPARATUS PROVIDING THERMAL MANAGEMENT FOR RADIO FREQUENCY DEVICES

BACKGROUND

1. Field

The present application relates generally to the operation of wireless communication systems, and more particularly, to an apparatus for providing thermal management for radio frequency devices.

2. Background

Wireless communication devices typically use power amplifiers to transmit radio frequency signals to communicate with other devices. The power amplifiers are typically coupled to an antenna, such as a Planar Inverted F Antenna (PIFA) that is tuned for optimal performance. However, transmitting signals at high power levels can lead to a device experiencing higher than acceptable operating temperatures. Furthermore, the need for wireless devices to be as small as possible in order to be competitive in the market place has resulted in increased power densities, which have further increased operating temperatures. Unfortunately, operating at high temperatures may result in decreased performance or other heat related problems, such as reduced reliability, reduced data rates, or excessively hot touch temperatures.

Several techniques have been used to overcome the problems associated with increased operating temperatures. One technique involves performance throttling (i.e., adjusting data rates, transmit power, etc.) to reduce or limit high temperature exposure to sensitive components. Other techniques that have been used to cool components and dissipate heat include filling air gaps within a device with thermally conductive gap fillers, increasing board area and/or product size, adding vents, and adding fans.

Unfortunately, the above techniques may not be effective in reducing operating temperatures or may result in added material cost, increased product size, or degraded device performance. For example, in a device that utilizes a PIFA, gap fillers are not appropriate since a PIFA typically requires a low loss dielectric, such as air, between the antenna elements and the ground plane for good performance.

Therefore, it would be desirable to have a mechanism that overcomes the problems associated with increased operating temperatures described above thereby allowing high performance compact devices to be built.

BRIEF DESCRIPTION OF THE DRAWINGS

The foregoing aspects of a heat conducting antenna system described herein will become more readily apparent by reference to the following Description when taken in conjunction with the accompanying drawings wherein.

DESCRIPTION

The following description describes implementations of a heat conducting antenna system that operates to provide thermal management for radio frequency (RF) devices.

Figure 1:
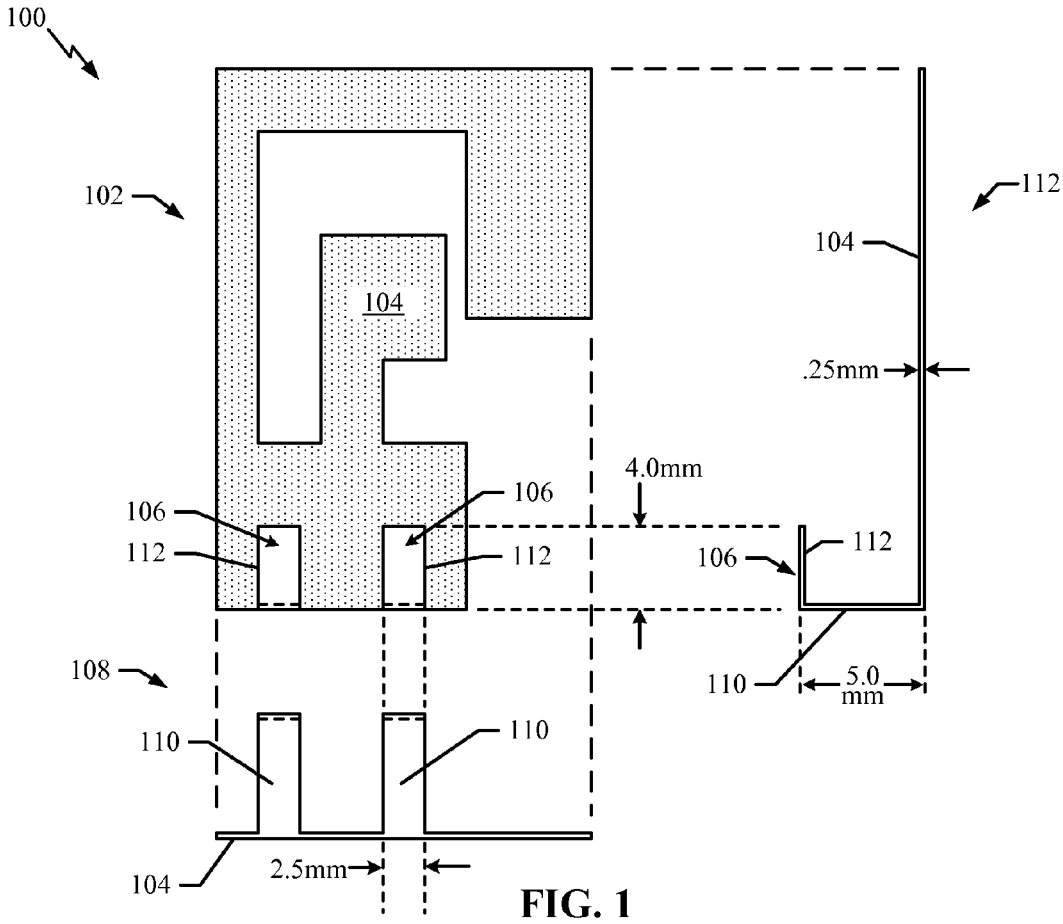
FIG. 1 shows three views of an exemplary PIFA antenna constructed in accordance with the heat conducting antenna system.

FIG. 1 shows three views of an exemplary PIFA antenna 100 constructed in accordance with the heat conducting antenna system. Referring to front view 102, an antenna body 104 and two mounting feet 112 having conductive mounting surfaces 106 are illustrated. The antenna body 104 forms a PIFA antenna which may have any desired geometry to achieve any particular transmission and/or reception characteristics. The antenna body 104 is comprised of metal, such as copper, to perform the transmission of electrical signals. The antenna body 104 is also thermally conductive. The mounting feet 112 and conductive mounting surfaces 106 are also formed from a thermally conductive material, such as metal, and may also conduct electrical signals to the antenna body 104 for transmission. It should also be noted that the heat conducting antenna system is not limited to use with only PIFA antennas and that the system is suitable for use with other types of antennas, such as whip antennas, patch antennas, meandered patch antennas, or other types of antennas.

Referring to end view 108, two mounting members 110 are illustrated. The mounting members 110 are also referred to as a feed leg and a short leg. The feed leg feeds a signal to be transmitted to the antenna body 104. The short leg is typically coupled to a signal ground. The mounting members 110 function to extend the mounting feet 112 and conductive mounting surfaces 106 away from the antenna body 104 to allow mounting the antenna 100 to a circuit board or other surface without interfering with other components that may be mounted on that surface. In one implementation, the mounting members 110, mounting feet 112, and conductive mounting surfaces 106 are formed together with the antenna body 104 so as to form one continuous thermally conductive unit.

In another implementation, the mounting members 110 and mounting feet 112 with their conductive mounting surfaces 106 are formed separately and attached to the antenna body 104 using a thermally conductive attachment mechanism. When formed separately, the mount members 110 and mounting feet 112 are comprised of thermally conductive material, such as metal and may also conduct electrical signals to the antenna body 104 for transmission. Thus, heat energy experienced by the conductive mounting surfaces 106 can flow through the mounting feet 112 and the mounting members 110 and into the antenna body 104.

Referring to side view 112, the orientation of the antenna body 104, mounting members 110, mounting feet 112 and thermally conductive mounting surfaces 106 are further illustrated.

In one implementation, the PIFA antenna 100 is formed from sheet metal or copper. However, the PIFA antenna 100 can be constructed from any suitable material having appropriate thermal and electrical qualities. In other implementations, the antenna 100 may be formed by photo etching, stamping, molding, assembling individual components, or plating on a carrier. As can be seen in FIG. 1, in this particular embodiment, the mounting members 110 are dimensioned to be 2.5 mm by 5.0 mm and the mounting feet 112 are dimensioned to be 2.5 mm by 4.0 mm to provide conductive mounting surfaces 106 having a surface area of 10 $mm^2$. The thickness of the antenna 100 is 0.25 mm; however, other thicknesses of the various antenna portions are possible. These dimensions are exemplary and not intended to limit the sizes of the mounting members 110, mounting feet 112 or conductive mounting surfaces 106.

In various implementations of the heat conducting antenna system, the dimensions of the mounting feet 112 and conductive mounting surfaces 106 are chosen to provide selected surface area and/or selected thermal resistance values. The dimensions of the mounting members 110 are also chosen to provide selected thermal resistance values. The combination of mounting surfaces 106, mounting feet 112 and mounting members 110 are selected to provide a range of thermal resistance values that allow heat energy to freely flow from the conductive mounting surfaces 106 to the antenna body 104. A more detailed description of the size selection and calculation of thermal resistances for the mounting surfaces 106, mounting feet 112 and mounting members 110 is provided below.

During operation, the PIFA antenna 100 performs as an antenna for the transmission of electrical signals and also performs as a heat sink to dissipate heat experienced at the conductive mounting surfaces. For example, in one implementation, the PIFA antenna 100 is incorporated into a handheld device such that the antenna body 104 is exposed to the ambient environment outside the device and the conductive mounting surfaces 106 are in contact with the device's internal circuit board. For example, the conductive mounting surfaces 106 are coupled to the circuit board in close proximity to a device power amplifier. The conductive mounting surfaces 106 operate to conduct heat away from the circuit board, through the mounting feet 112 and mounting members 110 to allow the heat energy to flow into the antenna body 104. The heat energy then dissipates from the antenna body 104 into the ambient environment. A more detailed description of the PIFA antenna 100 is provided below.

Figure 2:
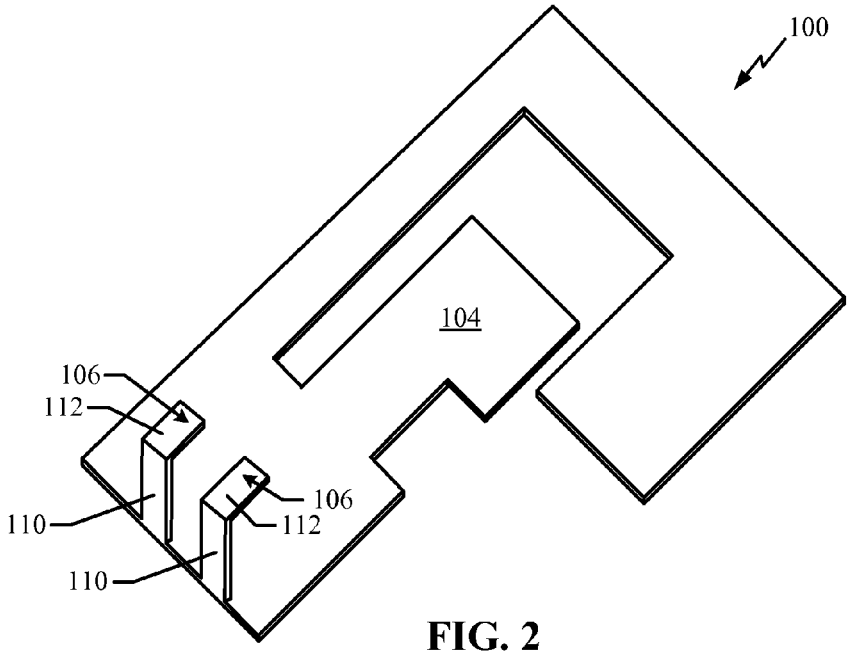
FIG. 2 shows a perspective view of the PIFA antenna of FIG. 1.

FIG. 2 shows a perspective view of the exemplary PIFA antenna 100 illustrating the arrangement and orientation of the antenna body 104, mounting members 110, mounting feet 112 and thermally conductive mounting surfaces 106. The height of the mounting members 110 may be adjusted to accommodate the distance between the external housing of a device and the location of the surface within a device from which heat is to be dissipated, such as an internal circuit board.

Figure 3:
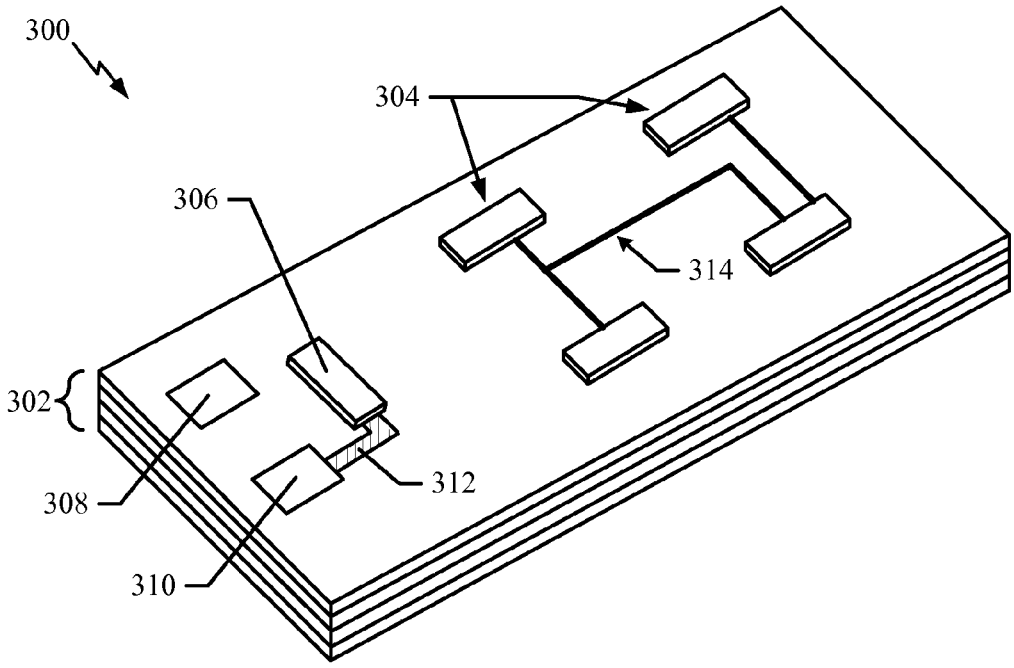
FIG. 3 shows an exemplary circuit board for use in conjunction with implementations of the heat conducting antenna system.

FIG. 3 shows an exemplary circuit board 300 for use in conjunction with implementations of the heat conducting antenna system. The circuit board 300 comprises one or more layers 302 or planes that are used to route signals between components. Components, shown generally at 304, are mounted on the circuit board 300 and communicate signals to each other utilizing routing traces, shown generally at 314, on one or more of the layers 302. It will be assumed that component 306 is a power amplifier that generates heat during operation that increases the temperature of the circuit board which may affect the operation of one or more of the components 304. For example, the power amplifier 306 may generate large amounts of heat when amplifying electrical signals for transmission.

The circuit board 300 also comprises mounting pads 308 and 310. In this example, it will be assumed that mounting pad 308 is coupled to a ground plane of the circuit board 300 and that the mounting pad 310 is connected to routing trace 312 which is further connected to the output of the power amplifier 306. Thus, the mounting pad 308 provides thermal access to the ground plane of the circuit board 300, which may experience a heat increase due to the operation of the components 304 and/or the power amplifier 306. For example, the mounting pad 308 may be directly connected to a ground plane that is positioned on the top surface of the circuit board 300 and covered by a thin mask layer, or the mounting pad 308 may be connected to an internal ground plane by one or more connecting vias. The mounting pad 310 provides access to output of the power amplifier 306, which may also experience a heat increase as the power amplifier amplifies signals for transmission. In one implementation, the power amplifier 306 is positioned to within 120 mm of at least one of the mounting pads 308 and 310.

In one implementation of the heat conducting antenna system, the PIFA antenna 100 is mounted to the circuit board 300 so that the two conductive mounting surfaces 106 are connected to the mounting pads 308 and 310, respectively. For example, the conductive mounting surface 106 associated with the feed leg is mounted to the pad 310 and the conductive mount surface 106 associated with the short leg is mounted to the pad 308. This arrangement allows electrical signals from the power amplifier 306 to be coupled by the feed leg to the PIFA antenna for transmission.

Furthermore, thermal energy generated during operation of the circuit board due to the components 304 and/or the power amplifier 306 can dissipate from the ground plane to the conductive mounting surface 106 associated with the short leg and thus be dissipated to the ambient environment by the PIFA antenna body 104. Thus, the heat conducting antenna system conducts heat energy away from the circuit board allowing the circuit board to operate at lower temperatures, and thereby avoid problems associated with operation at higher temperatures.

Figure 4:
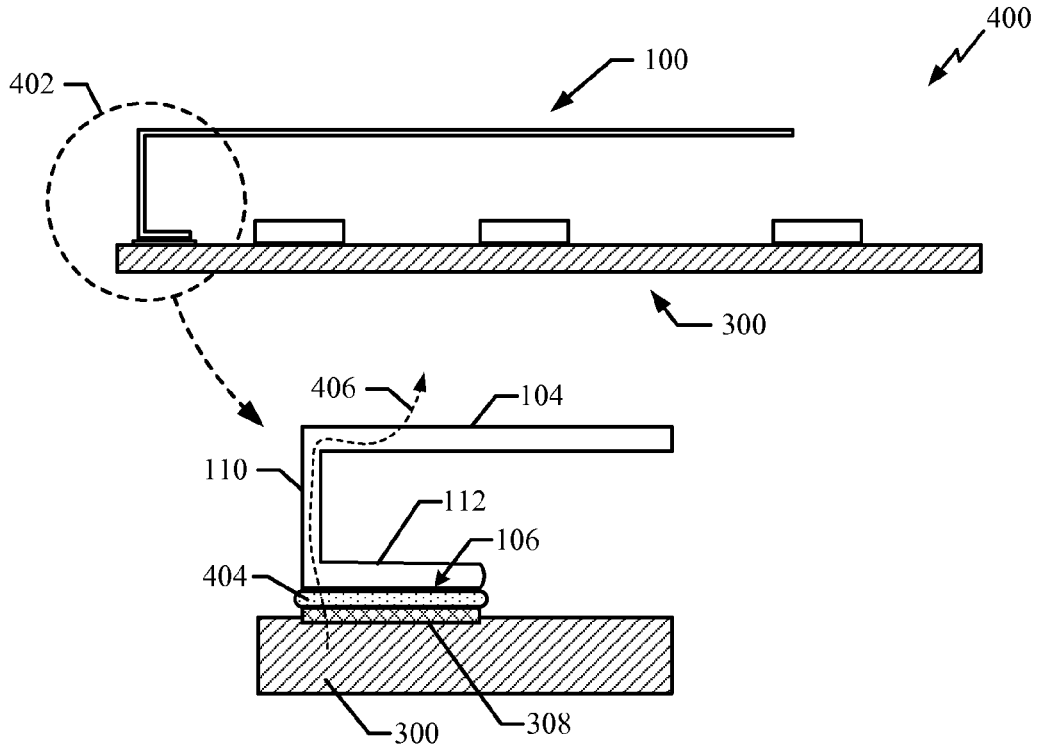
FIG. 4 shows an exemplary device assembly constructed in accordance with the heat conducting antenna system.

FIG. 4 shows an exemplary device assembly 400 constructed in accordance with the heat conducting antenna system. The device assembly 400 comprises the PIFA antenna 100 coupled to the circuit board 300. The region 402 shows the coupling of the antenna 100 to the circuit board 300 in further detail.

The region 402 shows the circuit board 300, circuit board mounting pad 308, mounting foot 112, and conductive mounting surface 106. In one implementation, the conductive mounting surface 106 is soldered to the circuit board mounting pad 308. In another implementation, the conductive mounting surface 106 is capacitively coupled to the circuit board mounting pad 308. In the case of capacitive coupling, a conductive thermal material 404 with appropriate dielectric properties for antenna performance is used between the mounting pad 308 and the conductive mounting surface 106 to facilitate heat transfer and the appropriate antenna performance. In still another implementation, the conductive mounting surface 106 is pressed to the circuit board mounting pad 308 using a screw or some other attachment means to form a pressure coupling.

During operation, heat generated by operation of the components of the circuit board 300, such as the power amplifier 306, is conducted to the PIFA antenna 100 through the mounting pad 308 to mounting surface 106 coupling. The heat energy is then dissipated through the mounting foot 112, mounting member 110 and antenna body 104 and into the ambient environment, as illustrated by heat flow line 406. Thus, the PIFA antenna 100 operates to provide two functions. The first being the transmission of electrical signals and the second being the dissipation of heat from the circuit board 300. This allows the circuit board to operate at lower temperatures, and thereby rendering unnecessary operating techniques in response to heat build up, such as performance throttling, or the addition of vents or fans.

Figures 5, 6:
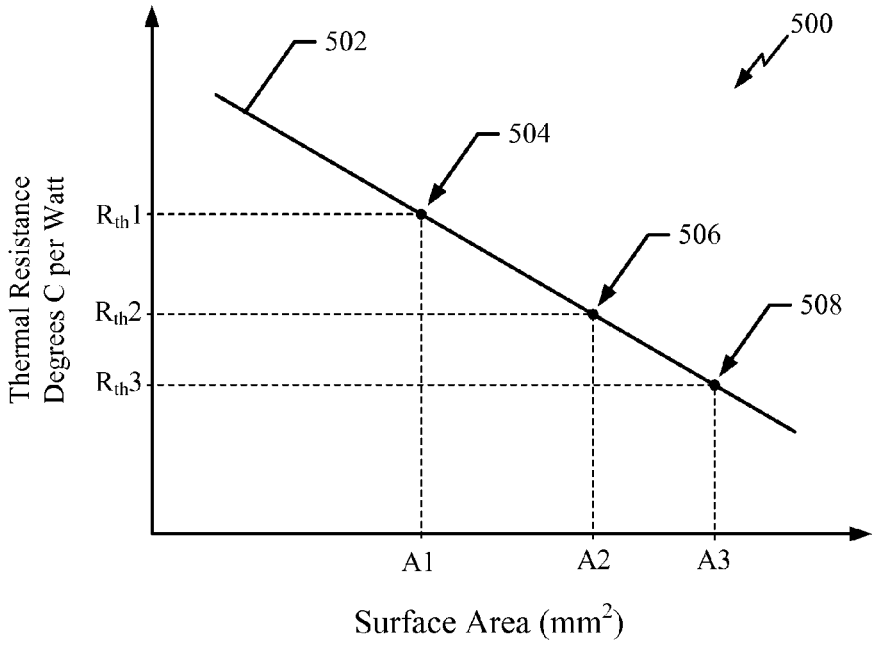
FIG. 5 shows an exemplary graph illustrating the relationship between thermal resistance and contact surface area in accordance with the heat conducting antenna system.
FIG. 6 shows an exemplary table illustrating thermal resistance calculations for various antenna portions in accordance with the heat conducting antenna system.

FIG. 5 shows an exemplary graph 500 illustrating the relationship between thermal resistance ($R_{th}$) and contact surface area (A) of the conductive mounting surfaces 106 in accordance with the heat conducting antenna system. The vertical axis of the graph 500 represents thermal resistance in degrees centigrade per watt and the horizontal axis of the graph 500 represents the total thermal conducting surface area of the conductive mounting surfaces 106 in square millimeters.

The graph 500 includes a plot line 502 that illustrates how thermal resistance decreases as the total surface area of the conductive mounting surfaces 106 increases. Three points (504, 506, and 508) are shown that indicate particular surface areas and associated thermal resistances. For example, at point 504, a first surface area (A1) corresponds to a first thermal resistance ($R_{th}$1), and at points 506 and 508, surface areas A2 and A3 correspond to $R_{th}$2 and $R_{th}$3, respectively. Thus, for a given contact surface area a corresponding thermal resistance can be determined.

Thermal Resistance Calculation

In various implementations of the heat conducting antenna system, a resulting thermal resistance is determined based on a combination of the thermal resistances of the connection between the conductive mounting surface 106 and the surface of the circuit board, the thermal resistance of the mounting feet 112, and the thermal resistance of the mounting members 110. The following expression can be used to determine the thermal resistance of each of the above identified portions of the antenna.

$$R_{th}=t/(k*A)$$

In the above expression, $R_{th}$ is the thermal resistance in degrees centigrade per watt, t represents the thickness of the material in (mm) in the direction of the heat flow, k is a thermal conductivity parameter for the material, and A is the cross sectional area of the material in ($mm^2$) perpendicular to the heat flow. Thus, a resulting thermal resistance from a surface, such as the circuit board 300 to the antenna body 104 can be determined by summing the thermal resistances of three components, namely; the connection between the circuit board and the conductive mounting surface 106, the mounting foot 112 and the mounting member 110.

FIG. 6 shows an exemplary table 600 illustrating the thermal resistance calculated for each portion of the antenna shown in view 402. For example, for each antenna portion 602, a thermal resistance 604 is calculated based on the above expression using the specified values for t 606, k 608, length (L) 610, width (W) 612 and area (A) 614.

As can be see in table 600, for a solder connection, thermal resistances for two solder connection types of specified sizes are shown at 616. For a capacitively coupled connection, thermal resistances are shown for three different thermal interface materials at 618. The thermal resistances for three mounting foot materials of specified sizes are shown at 620 and for three mounting leg materials of specified sizes are shown at 622.

Thus, in various implementations, the resulting thermal resistance of the antenna 100 is comprised of the thermal resistance (either 616 or 618) of the connection between the mounting surfaces 106 and the circuit board, the thermal resistance (620) of the mounting foot 112 based on its material and size, and the thermal resistance (622) of the mounting member (or leg) based on its material and size. This represents the thermal resistance for one mounting surface and associated structural components. For two mounting surfaces, as provided by the antenna 100, the resulting thermal resistance is divided by two.

Table 1 show values for thermal resistance provided in an exemplary antenna implementation of the heat conducting antenna system based on the measurements of the antenna 100 and other information provided in the table 600. For example, the antenna implementation comprises a connection type, a foot type and a leg type which are added together to determine a resulting thermal resistance. An antenna having multiple mounting surfaces will have multiple connection, foot and leg types and the resulting thermal resistance can be determined from a combination of the thermal resistance associated with all antenna components. For example, to determine the resulting thermal resistance of multiple thermal paths, the thermal resistances of the paths are combined similarly to the way electronic resistors are combined to determine a resulting electrical resistance. For example, series resistors are added to determine a resulting electrical resistance. Two parallel resistors are combined according to (R1*R2)/(R1+R2) to determine a resulting electrical resistance. It should be noted that Table 1 is only exemplary and that other implementations having different connection, feet and leg types are possible.

TABLE 1

| Implementation | $R_{th}$ (° C./watt) | Connection type | Foot | Leg |
|---|---|---|---|---|
| 1 | For 1 surface<br>21.6 | Solder type 1<br>.30 | Cu<br>.52 | Cu<br>20.78 |

Because the antenna 100 comprises two mounting surfaces, the resulting thermal resistance will be a combination of the thermal resistance associated with each surface. The final result can be determined by dividing by two, which means the resulting thermal resistance for the antenna 100 based on the given dimensions is 10.8. Therefore, the based on the above specifications and dimensions, an upper boundary for the thermal resistance provided by implementations of the heat conducting antenna system is set to a value of 15° C./watt.

Although there are two conductive mounting surfaces 106 provided by the antenna 100, the system is suitable for use with any number of conducting mounting surfaces and associated foot and leg structures. The dimensions of these structures are used to determine the resulting net thermal resistance. For example, in one implementation, the antenna 100 is constructed to have only one mounting surface. In another implementation, the antenna 100 is constructed to have three or more mounting surfaces. Thus, any number of mounting surfaces and associated foot and leg structures may be provided and the above expression is used to determine the thermal resistance for each portion and the resulting thermal resistance taking into account all mounting surfaces and associated structures. For example, an antenna with one mounting surface may have a resulting resistance of $R_{th}$ while an antenna with two identical mounting surfaces and associated structures will have a thermal resistance of $R_{th}/2$.

In one implementation, the antenna 100 is dimensioned to provide a thermal resistance of less than 15 degrees centigrade per watt and greater than or equal to 12 degrees centigrade per watt. In another implementation, the antenna 100 is dimensioned to provide a thermal resistance of less than 12 degrees centigrade per watt and greater than 10 degrees centigrade per watt. In another implementation, the antenna 100 is dimensioned to provide a thermal resistance of less than 10 degrees centigrade per watt and greater than 8 degrees centigrade per watt. In another implementation, the antenna 100 is dimensioned to provide a thermal resistance of less than 8 degrees centigrade per watt and greater than 6 degrees centigrade per watt. In another implementation, the antenna 100 is dimensioned to provide a thermal resistance of less than 6 degrees centigrade per watt and greater than 4 degrees centigrade per watt. In another implementation, the antenna 100 is dimensioned to provide a thermal resistance of less than 4 degrees centigrade per watt and greater than 2 degrees centigrade per watt. In another implementation, the antenna 100 is dimensioned to provide a thermal resistance of less than 2 degrees centigrade per watt and greater than 1 degree centigrade per watt. In another implementation, the antenna 100 is dimensioned to provide a thermal resistance of less than 1 degree centigrade per watt and greater than 0.5 degrees centigrade per watt.

Figure 7:
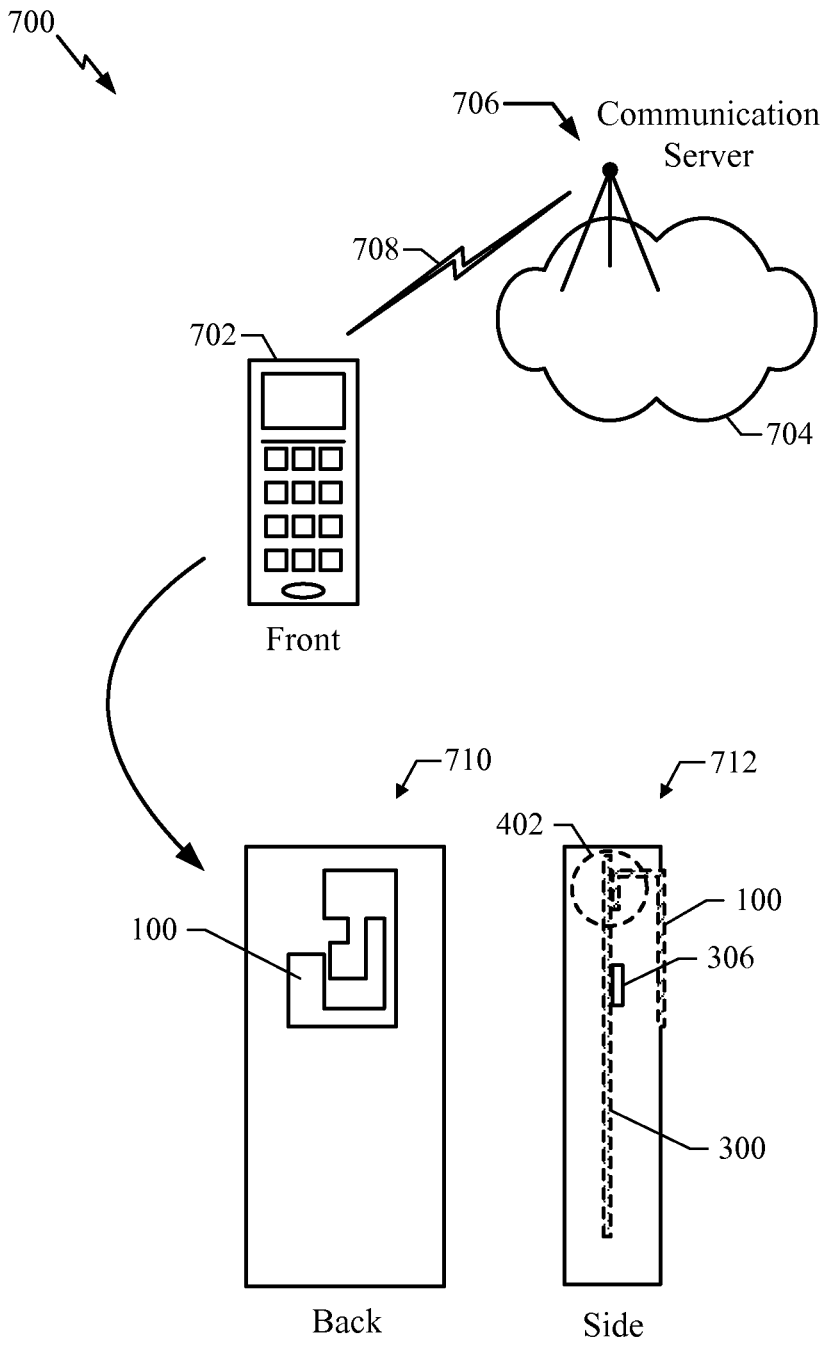
FIG. 7 shows an exemplary device that comprises the heat conducting antenna system.

FIG. 7 shows a communication network 700 and an exemplary device 702 that comprises the heat conducting antenna system. The communication network 700 comprises network 704 which may be any type of wired and/or wireless communication network. The network 704 comprises communication server 706 which operates to communicate with the device 702 using a wireless transmission link 708. It should be noted that although only one device is shown, the communication server 706 may wirelessly communication with any number of devices.

The device 702 is constructed in accordance with the heat conducting antenna system and comprises the PIFA antenna 100 shown in FIG. 1. For example, a back view 710 of the device 702 shows that the PIFA antenna 100 is exposed to the ambient environment to allow heat to dissipate. A side view 712 of the device 702 shows the internal circuit board 300 with power amplifier 306, the junction region 402 and the PIFA antenna 100 extending and exposed outside the device to the ambient environment. The above described calculation of thermal resistance for each portion of the antenna 100 is performed based on the coupling size and type, foot size and material, and leg size and material to determine a resulting thermal resistance. For example, the thermal resistance may correspond to the implementation shown in Table 1.

During operation, the circuit board, power amplifier, and associated components generate heat. For example, a power amplifier 306 on the circuit board 300 generates heat when transmitting signals to the communication server 706. The heat energy flows from the mounting pads 308 and 310 to the conductive mounting surfaces 106 of the PIFA antenna 100 and is dissipated into the ambient environment through the mounting foot 112, mounting leg 110 and PIFA antenna body 104. Thus, the temperature of the circuit board 300 and its associated components can be managed without the use of performance throttling or other heat compensating techniques.

Figure 8:
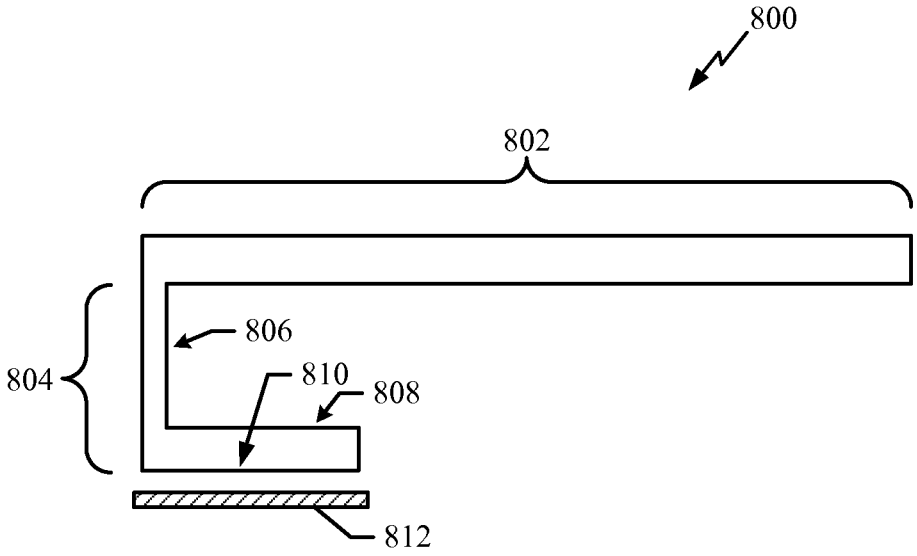
FIG. 8 shows an exemplary antenna apparatus constructed in accordance with the heat conducting antenna system.

FIG. 8 shows an exemplary antenna apparatus 800 constructed in accordance with the heat conducting antenna system. In one implementation, the antenna apparatus 800 is comprised of metal or other thermally conductive material.

The antenna apparatus 800 comprises antenna body means (802) for transmitting electrical signals. The antenna body means 802 may be a PIFA antenna, whip antenna, patch antenna, a meandered patch antenna or any other type of antenna. The antenna apparatus 800 also comprises mounting means (804), for coupling the antenna body means 802 to a device surface. In one implementation, the mounting means 804 comprises mounting member means 806 and mounting foot means 808, which comprise metal or other thermally conductive material. The mounting foot means comprises a mounting surface 810 for mounting the antenna apparatus 800 to a surface, such as a circuit board, using a connection means 812, which comprises solder or thermally conductive material. The resulting thermal resistance provided by the antenna apparatus 800 is based on the thermal resistance of the connection means 812, mounting foot means 808 and mounting member means 808. In one or more implementations, the thermal resistance is less than 15 degrees centigrade per watt.

The description of the disclosed aspects is provided to enable any person skilled in the art to make or use the present invention. Various modifications to these aspects may be readily apparent to those skilled in the art, and the generic principles defined herein may be applied to other aspects without departing from the spirit or scope of the invention. Thus, the present invention is not intended to be limited to the aspects shown herein but is to be accorded the widest scope consistent with the principles and novel features disclosed herein. The word "exemplary" is used exclusively herein to mean "serving as an example, instance, or illustration." Any aspect described herein as "exemplary" is not necessarily to be construed as preferred or advantageous over other aspects.

Accordingly, while aspects of a heat conducting antenna system have been illustrated and described herein, it will be appreciated that various changes can be made to the aspects without departing from their spirit or essential characteristics. Therefore, the disclosures and descriptions herein are intended to be illustrative, but not limiting, of the scope of the invention, which is set forth in the following claims.

What is claimed is:

1. An antenna for thermal management in a device, the antenna comprising:

an antenna body configured for transmitting electrical signals;

one or more mounting surfaces coupled to the antenna body, the one or more mounting surfaces configured for mounting to a device surface, the one or more mounting surfaces sized to provide a thermal resistance (Rth) between the device surface and the antenna body that is less than 15 degrees centigrade per watt; and thermally conductive material coupled between the one or more mounting surfaces and the device surface to facilitate heat transfer.

2. The antenna of claim 1, wherein the one or more mounting surfaces are configured to mount to the device surface utilizing one or more connection types, respectively, wherein each of the one or more connection types is selected from a set consisting of: a solder connection, a pressure connection, and a capacitively coupled connection.

3. The antenna of claim 2, wherein the one or more mounting surfaces are coupled to one or more mounting feet, and the one or more mounting feet are coupled to the antenna body by one or more mounting legs so that the resulting thermal resistance is a combination of thermal resistances associated with the one or more connection types, the one or more mounting feet, and the one or more mounting legs.

4. The antenna of claim 3, wherein thermal resistances associated with the one or more connection types, the one or more mounting feet, and the one or more mounting legs are determined from $Rth=t/(k*A)$, where t represents a material thickness in a heat flow direction, k is a thermal conductivity parameter, and A is a cross sectional area of the material perpendicular to the heat flow direction.

5. The antenna of claim 4, wherein the one or more connection types, the one or more mounting feet, and the one or more mounting legs are dimensioned so that the resulting thermal resistance in degrees centigrade per watt is in a range selected from a set of ranges consisting of: 15>Rth≥12, 12>Rth≥10, 10>Rth≥8, 8>Rth≥6, 6>Rth≥4, 4>Rth≥2, 2>Rth≥1, and 1>Rth≥5.

6. The antenna of claim 1, wherein at least one mounting surface is configured to conduct the electrical signals between the device surface and the antenna body.

7. The antenna of claim 1, wherein the antenna body forms one of a PIFA antenna, whip antenna, patch antenna, or a meandered patch antenna.

8. An antenna apparatus for thermal management in a device, the apparatus comprising:

an antenna body means for transmitting electrical signals;

mounting means coupled to the antenna body means, the mounting means for mounting to a device surface, the mounting means sized to provide a thermal resistance between the device surface and the antenna body means that is less than 15 degrees centigrade per watt; and means for thermal conductivity coupled between the mounting means and the device surface to facilitate heat transfer.

9. The apparatus of claim 8, wherein the mounting means comprises connection means for mounting to the device surface.

10. The apparatus of claim 9, wherein the mounting means comprises mounting foot means for supporting the connection means and mounting leg means for mounting the mounting foot means to the antenna body means, so that the resulting thermal resistance is a combination of thermal resistances associated with the connection means, the mounting foot means, and the mounting leg means.

11. The apparatus of claim 10, wherein the connection means, the mounting foot means, and the mounting leg means are dimensioned so that the resulting thermal resistance in degrees centigrade per watt is in a range selected from a set of ranges consisting of: 15>Rth≥12, 12>Rth≥10, 10>Rth≥8, 8>Rth≥6, 6>Rth≥4, 4>Rth≥2, 2>Rth≥1, and 1>Rth≥5.

12. A device comprising:

a power amplifier (PA);

an antenna body configured for transmitting electrical signals from the power amplifier;

one or more mounting surfaces coupled to the antenna body, the one or more mounting surfaces configured for mounting to a device surface, the one or more mounting surfaces sized to provide a thermal resistance (Rth) between the device surface and the antenna body that is less than 15 degrees centigrade per watt; and thermally conductive material coupled between the one or more mounting surfaces and the device surface to facilitate heat transfer.

13. The device of claim 12, wherein the one or more mounting surfaces are configured to mount to the device surface by one or more connection types, respectively, wherein each of the one or more connection types is selected from a set consisting of: a solder connection, a pressure connection, and a capacitively coupled connection.

14. The device of claim 13, wherein the one or more mounting surfaces are coupled to one or more mounting feet, and the one or more mounting feet are coupled to the antenna body by one or more mounting legs so that the resulting thermal resistance is a combination of thermal resistances associated with the one or more connection types, the one or more mounting feet, and the one or more mounting legs.

15. The device of claim 14, wherein thermal resistances associated with the one or more connection types, the one or more mounting feet, and the one or more mounting legs are determined from Rth=t/(k*A), where t represents a material thickness in a heat flow direction, k is a thermal conductivity parameter, and A is a cross sectional area of the material perpendicular to the heat flow direction.

16. The device of claim 15, wherein the one or more connection types, the one or more mounting feet, and the one or more mounting legs are dimensioned so that the resulting thermal resistance in degrees centigrade per watt is in a range selected from a set of ranges consisting of: 15>Rth≥12, 12>Rth≥10, 10>Rth≥8, 8>Rth≥6, 6>Rth≥4, 4>Rth≥2, 2>Rth≥1, and 1>Rth≥5.

17. The device of claim 12, wherein the device surface is a circuit board comprising a power amplifier that is located within 120 millimeters of at least one mounting surface.

18. The device of claim 12, wherein the antenna body is exposed outside the device to dissipate heat energy to an ambient environment.

19. The device of claim 12, wherein the antenna body forms one of a PIFA antenna, whip antenna, patch antenna, or a meandered patch antenna.

20. The device of claim 12, wherein the device is a handheld device.

* * * * *